United States Patent [19]

Feldman

[11] 4,184,851

[45] Jan. 22, 1980

[54] BORATED DERIVATIVES OF HYDROCARBON SUBSTITUTED SUCCINAMIC ACIDS AND/OR ACID SALTS THEREOF ARE FLOW IMPROVERS FOR MIDDLE DISTILLATE FUEL OILS (PT-364)

[75] Inventor: Nicholas Feldman, Woodbridge, N.J.

[73] Assignee: Exxon Research & Engineering Co., Florham Park, N.J.

[21] Appl. No.: 970,255

[22] Filed: Dec. 18, 1978

Related U.S. Application Data

[63] Continuation of Ser. No. 818,612, Jul. 25, 1977, abandoned.

[51] Int. Cl.[2] ..... C10L 1/22; C07C 107/02

[52] U.S. Cl. ..... 44/71; 260/462 R

[58] Field of Search ..... 260/462 R; 44/71

[56] References Cited

U.S. PATENT DOCUMENTS

| | | | |
|---|---|---|---|
| 3,087,936 | 4/1963 | LeSuer | 260/462 R |
| 3,444,082 | 5/1969 | Kantsky | 252/51.5 |
| 3,533,945 | 10/1970 | Vogel | 260/462 R |
| 3,544,467 | 12/1970 | Kantsky | 44/71 |
| 3,846,093 | 11/1974 | Feldman | 44/80 |
| 3,850,587 | 11/1974 | Frost | 44/62 |
| 3,961,916 | 6/1976 | Hnyckyj | 44/62 |
| 3,991,098 | 11/1976 | Okamoto | 260/462 R |
| 4,014,663 | 3/1977 | Feldman | 44/71 |

FOREIGN PATENT DOCUMENTS

| | | | |
|---|---|---|---|
| 1271556 | 4/1972 | United Kingdom | 44/71 |

*Primary Examiner*—John F. Niebling

*Attorney, Agent, or Firm*—Roland A. Dexter; Frank T. Johmannn

[57] ABSTRACT

Borated derivatives of $C_8$ to $C_{40}$ hydrocarbyl substituted succinamic acids and/or acid salts thereof, preferably obtained by the reaction of boric acid with an aliphatic hydrocarbyl succinamic acid derivative, are useful alone and in combination with an amorphous hydrocarbon in improving the cold flow properties of distillate hydrocarbon oils.

7 Claims, No Drawings

BORATED DERIVATIVES OF HYDROCARBON SUBSTITUTED SUCCINAMIC ACIDS AND/OR ACID SALTS THEREOF ARE FLOW IMPROVERS FOR MIDDLE DISTILLATE FUEL OILS (PT-364)

This is a continuation of application Ser. No. 818,612, filed July 25, 1977 now abandoned.

BACKGROUND OF THE INVENTION

1. Field of the Invention

The invention relates to a borated compound alone or in combination with an amorphous hydrocarbon as middle distillate fuel flow improvers.

2. Description of the Prior Art

Heating oils and other middle distillate petroleum fuels, e.g., diesel fuels, contain normal paraffin hydrocarbon waxes which, at low temperatures, tend to precipitate in large crystals in such a way as to set up a gel structure which causes the fuel to lose its fluidity thereby presenting difficulties in transporting the fuel through flow lines and pumps. The wax crystals that have come out of solution also tend to plug fuel lines, screens and filters. This problem has been well recognized in the past and various additives known as pour point depressants have been used to change the nature of the crystals that precipitate from the fuel oil, thereby reducing the tendency of the wax crystals to set into a gel. It is thus desirable to obtain not only fuel oils with low pour points, but also oils that will form small wax crystals so that the clogging of filters will not impair the flow of the fuel at low operating temperatures.

It is known in the prior art to employ various polymeric and copolymeric materials as pour point depressants for wax-containing petroleum fractions.

Recently, it has become known that pour point depression alone is not a sufficient phenomenon to alleviate some problems caused by wax crystals in various fuels, especially middle distillates. In those petroleum fractions, it has been observed that the wax crystals formed in the presence of the pour point depressant are often too large to enable the wax-cloudy fuels to pass easily through screens and orifices commonly encountered in the equipment employed either in distribution or in use of such fuels. This problem has been alleviated by the addition to said fraction of petroleum products of wax crystal modifiers which are referred to as flow and filterability improvers.

U.S. Pat. No. 3,961,916 teaches that the low temperature flow characteristics of petroleum middle distillates can be very satisfactorily controlled by the proper choice of a combination of a nucleating agent or wax growth stimulator and a wax crystal growth arrester.

Numerous other additive combinations are taught for modifying the cold flow characteristics of petroleum fuels including:

U.S. Pat. No. 3,444,082 teaches that a combination of alkenyl succinamic acid and the amine salts thereof with ethylene copolymers are good for reducing the pour point of various petroleum fuels;

U.S. Pat. No. 3,846,093 modifies the low temperature filterability of middle distillate fuels by the addition of an N-aliphatic hydrocarbyl succinamic acid or derivative thereof and an amorphous hydrocarbon;

U.S. Pat. No. 3,850,587 teaches of a three-component flow-improver admixture for waxy hydrocarbonaceous fuels comprising: (1) a $C_8$ to $C_{28}$ hydrocarbyl succinamic acid mono- or disubstituted on the nitrogen atom with $C_8$ to $C_{28}$ hydrocarbyl groups; (2) an ethylene-vinyl acetate polymer containing from 10 to 40 weight percent vinyl acetate and having a molecular weight between 800 and about 10,000, and (3) an aromatic acid having from 7 to 20 carbons; and, U.S. Pat. No. 4,014,663 teaches a synergistic mixture based on the combination of said succinamic acid or derivative thereof and a hydrocarbon which is a derivative of an alpha-olefin.

SUMMARY OF THE INVENTION

It has been found that the borated derivative of said succinamic acid or derivative thereof by itself or in combination with an amorphous hydrocarbon further improves the cold flow characteristics of a middle distillate petroleum fuel oil boiling within the range of about 120° C. to about 400° C. at atmospheric pressure.

In accordance with the present invention, a fuel composition is provided which comprises a major proportion, i.e., more than 50% by weight, of a distillate petroleum fraction preferably having an atmospheric boiling range of from about 120° C. to about 400° C. and from about 0.001 to 1.0 wt. % of borated oil-soluble succinamic acid or its derivative having the following formula:

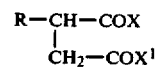

wherein: R is a straight chain aliphatic hydrocarbon group having from 0 to 1 site of olefinic unsaturation (alkyl or alkenyl) attached at a secondary carbon atom to the succinyl group and is of at least 8 carbon atoms, generally in the range of 14 to 40 carbon atoms and more usually in the range of 15 to 30 carbon atoms; one of X and $X^1$ is hydroxyl and the other is $$-NYY^1$$

wherein N has its normal meaning of nitrogen and Y and $Y^1$ are aliphatic hydrocarbyl groups of from 8 to 40 carbon atoms, more usually of from 14 to 30 carbon atoms, having a total of from about 30 to 52 carbon atoms, more usually of from 32 to 48 carbon atoms, optimally of from 32 to 40 carbon atoms; preferably said one of X and $X^1$ is of the formula:

$$OH(NHY^2Y^3)_n$$

wherein n varies from 0 to 1, $Y^2$ and $Y^3$ are the class of hydrogen, an aliphatic hydrocarbon of from 1 to 30 carbon atoms and oxyaliphatic hydrocarbon of from 3 to 30 carbon atoms, and $Y^2$ and $Y^3$ may be taken together with the nitrogen to which they are attached to form a heterocyclic ring of from 5 to 7 annular members.

In a preferred form said composition contains from about 0.01 to 1.0 wt. % of a flow and filterability improving combination comprising: (a) 1 to 5 parts by weight of said borated oil-soluble succinamic acid or its derivative; and (b) 1 to 100 parts by weight of an oil-soluble amorphous hydrocarbon, such as a saturated hydrocarbon fraction, having less than about 5, preferably less than about 1, wt. % of normal paraffin hydrocarbons, which can be illustrated by Coray 200 petrolatum. It is preferred that the weight ratio of a/b is in the range of 4:1 to 1:25, optimally 1:2 to 1:8.

Concentrates of 1 to 60 wt. % of said borated additive or borated additive-hydrocarbon combination in 40 to 99 wt. % of mineral oil, e.g., kerosene, can be prepared for ease of handling.

DETAILED DESCRIPTION OF THE INVENTION

The borated flow improver for distillate oils according to this invention is obtained by the reaction of a boron compound with an oil-soluble succinamic acid or its derivative of the general formula

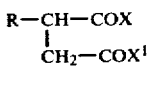

wherein: R is a straight chain aliphatic hydrocarbon group having from 0 to 1 site of olefinic unsaturation (alkyl or alkenyl) attached at a secondary carbon atom to the succinyl group and is of at least 8 carbon atoms, generally in the range of 14 to 40 carbon atoms and more usually in the range of 15 to 30 carbon atoms; one of X and $X^1$ is hydroxyl and the other is $$-NYY^1$$

wherein N has its normal meaning of nitrogen and Y and $Y^1$ are aliphatic hydrocarbyl groups of from 8 to 40 carbon atoms, more usually of from 14 to 30 carbon atoms, having a total of from about 30 to 52 carbon atoms, more usually of from 32 to 48 carbon atoms. In the preferred amine salt form the said one of X and $X^1$ is of the formula:

$$-OH(NHY^2Y^3)_n$$

wherein n varies from 0 to 1, $Y^2$ and $Y^3$ are selected from the class of hydrogen, aliphatic hydrocarbon of from 1 to 30 carbon atoms and oxyaliphatic hydrocarbon of from 3 to 30 carbon atoms, and $Y^2$ and $Y^3$ may be taken together with the nitrogen to which they are attached to form a heterocyclic ring of from 5 to 7 annular members.

Y and $Y^1$ are aliphatically saturated and generally free of acetylenic unsaturation although each may have 1 to 2 sites of olefinic unsaturation, Y and $Y^1$ may be the same or different and may be straight chain or branched chain, preferably straight chain. The branches will normally be not greater than 1 carbon atom, i.e., methyl. The position of attachment to nitrogen may be at a terminal or internal carbon atom.

As is evidenced from the above formula, it is not important which position the alkyl or alkenyl group has in relation to the carboxamide or carboxyl group. Because of the bulky nature of the amine, the usual method of preparation through the succinic anhydride will provide the alkyl or alkenyl group beta to the carboxamide as the major product. To the extent that this is the more easily accessible derivative, this derivative is preferred. However as far as operability is concerned, either isomer or a mixture of the two isomers may be used.

Individual compounds or mixtures of compounds may be used as pour point depressants. Mixtures of different C- and/or N-substituents, both as to homologs and isomers, will frequently be employed when the individual precursors to the succinamic acid product are not readily available.

Illustrative succinamic acids include N,N-dihexadecyl hexadecylsuccinamic acid, N-hexadecyl, N-octadecyl-octadecylsuccinamic acid, N,N-dihexadecenyl $C_{15-20}$ alkenylsuccinamic acid, N-hexadecenyl N-eicosenyl octadecylsuccinamic acid, N,N-dioctadecenyl $C_{16-18}$-alkenylsuccinamic acid, etc.

As indicated previously, the succinamic acid may be used as its amine salt, preferably as a mixture of acid and amine salt.

The amine salt or acid or mixtures thereof can be represented by the following formula:

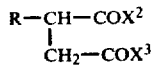

wherein R is as previously defined, one of the $X^2$ and $X^3$ is $-NYY^1$ wherein Y and $Y^1$ have been previously defined. The other of $X^2$ and $X^3$ is of the formula:

$$-OH(NHY^2Y^3)_n$$

wherein $Y^2$ and $Y^3$ may be hydrogen, aliphatic hydrocarbon of from 1 to 30 carbon atoms or oxaliphatic hydrocarbon (there being 1 ethereal oxygen atom present in the radical bonded to nitrogen at least B to the nitrogen atom) of from 3 to 30 carbon atoms and $Y^2$ and $Y^3$ may be taken together to form a heterocyclic ring of from 5 to 7 members having nitrogen and oxygen as the only heteromembers, n varies from 0 to 1, preferably from 0.1 to 0.9. That is, from 10 to 90 mole percent of the succinamic acid present is in the form of its salt.

The aliphatic hydrocarbon groups may be saturated or unsaturated usually having not more than one beta sites of ethylenic unsaturation. The total number of carbon atoms for $NHY^2Y^3$ will be from 0 to 60, usually 1 to 40.

The groups indicated for Y and $Y^1$ may also be used for $Y^2$ and $Y^3$. However, as already indicated, primary amines may be used as well as secondary amines to form the salt. Usually, where an amine other than the one used to prepare the succinamic acid is used to form the salt, as will be explained subsequently, there will be a mixture of salts; both the added amine and the secondary amine employed to prepare the succinamic acid will be involved in salt formation.

Illustrative amines which may be used to form salts are di-sec.-butyl amine, heptyl amine, dodecyl amine, octadecyl amine, tert.-butyl amine, morpholine, diethyl amine, methoxybutylamine, methoxyhexylamine, etc.

The alkenyl succinamic acid of this invention are readily prepared by reacting an alkyl or alkenyl succinic anhydride with the desired secondary amine at a temperature in the range of about 65° C. to 125° C. in approximately equimolar amounts, either neat or in the presence of an inert solvent. The time for the reaction is generally in the range of 15 minutes to 1 hour. The reaction is well known in the art and does not require extensive discussion here.

The alkyl or alkenyl succinic anhydride which is used may be individual compounds or mixtures of compounds. That is, various alkyl or alkenyl groups of differing number of carbon atoms or different positions of attachment to the succinic anhydride group may be used. Alternatively, a single isomer may be used. Since mixtures are generally more readily available, to that degree they are preferred. Frequently, mixtures will be used of aliphatic hydrocarbyl substituted succinic anhydrides wherein no single homolog is present in amount greater than 25 mole percent.

Various secondary amines may be used, both those having the same aliphatic hydrocarbon groups and those having different aliphatic hydrocarbon groups. Either alkyl or alkenyl substituents may be present on the nitrogen, each having at least 14 carbon atoms. The range of difference between the two aliphatic hydrocarbon groups bonded at the nitrogen is not critical but will generally be fewer than 8 carbon atoms, more usually fewer than 6 carbon atoms. For most part, the aliphatic hydrocarbon groups will be straight chain, i.e. normal with the amino nitrogen bonded either to internal or terminal carbon atoms.

It is believed that when using about a 1:1 to 2:1 mole ratio of amine to succinic anhydride, depending on the reaction conditions, one or more of the following compounds may be present: alkyl succinamic acid; an amine salt of said acid; and, an amide of said acid.

If the above reaction is carried out with water present at the beginning, the first reaction which could occur will be that of forming alkyl succinic acid. In this instance, the presence of the amine reactant, an additional compound, i.e., the diamine salt of the alkyl succinic acid, can also be present in the product.

The amine salts are readily prepared by adding the amine to the succinamic acid, conveniently as prepared, or in an inert solvent. Mild heating may facilitate the reaction.

Particularly effective is the above-described composition wherein the amine employed is hydrogenated di(-tallow) amine.

OIL-SOLUBLE BORATED SUCCINAMIC ACID REACTION PRODUCT

The boron compound useful in the reaction with the oil-soluble hydrocarbyl succinamic acid or amine salts thereof include boron oxide, boron oxide hydrate, boron acids such as boronic acid [e.g., alkyl-$B(OH)_2$ or aryl-$B(OH)_2$] and boric acids, preferably $H_3BO_3$, and esters of such boron acids.

Specific examples of boronic acids include methyl boronic acid, phenyl-boronic acid, cyclohexyl boronic acid, p-heptylphenyl boronic acid and dodecyl boronic acid.

The boric acid esters include mono-, di- and tri-substituted organic esters of boric acid with alcohols or phenols such as, e.g., butanol, octanol, cyclohexanol, cyclopentanol, ethylene glycol, 1,3-butanediol, 2,4-hexanediol, polyisobutene substituted phenols. Lower alcohols, 1,2-glycols, and 1,3-glycols, i.e., those having less than about 8 carbon atoms are especially useful for preparing the boric acid esters for the purpose of this invention. Methods for preparing the esters of boron acid are known and disclosed in the art (such as "Chemical Reviews" pp. 959–1064, Vol. 56).

The general process of forming the oil-soluble borated succinamates of the invention by reacting the succinamic material with the boron containing compound is usually carried out by heating a mixture of the reactants at a temperature above about 80° C., preferably within the range from about 100° C. to about 200° C. However, when boric acid or oxide is employed, the process is carried out at a lower temperature (such as 80° C. to 150° C.) preferably at about 120° C. The use of a solvent such as benzene, toluene, naphtha, mineral oil, xylene, n-hexane, or the like is often desirable in the above process to facilitate the control of the reaction temperature and removal of water. Polyols such as ethylene glycol or mannitol, can be used as a cosolvent and/or complexing means for said boron compound, particularly for boric acid or oxide.

The oil-soluble succinamic material reacts readily with the boron compounds, e.g., boric acid at these mildly elevated temperatures to form the borate complex of the invention. Since the substituted succinamic acid in the reaction has one carboxylic group and one amide group, the said acid material may be complexed with the boron compound in molar ratios of up to 1:2. It is desirable to complex sufficient boron compound with said succinamic acid material to provide from 0.1 to 2, preferably from about 0.2 to 0.9, wt. % boron, based on the total weight of the product in the borated complex product of the invention. The boron which appears to be in said product as a boric acid complex apparently attaches or is bonded to the succinamic acid material as a salt and/or chelate complex. The reaction is carried out to completion which ranges in time from about 0.5 to 10, preferably 1 to 7, hours after which the solvents are removed as by distillation or nitrogen stripping at reaction temperatures.

AMORPHOUS HYDROCARBON

The amorphous hydrocarbon useful in this invention as co-additive with the borated compound is an amorphous, normally solid essentially saturated hydrocarbon fraction having a number average molecular weight within the range from about 600 to about 3,000, said hydrocarbon fraction being substantially free of normal paraffinic hydrocarbons, preferably having no more than about 1 wt. % of normal paraffins, and having been obtained from a residual petroleum oil. The amorphous hydrocarbon is fully described in my U.S. Pat. No. 3,660,058 (see particularly column 2, lines 30 ff) which is incorporated herein by reference thereto.

An amorphous hydrocarbon fraction can be obtained by deasphalting a residual petroleum fraction and then adding a solvent such as propane, lowering the temperature of the solvent-diluted residuum, and recovering the desired solid or semi-solid amorphous product by precipitation, followed by filtration. The residual oil fractions from which the desired amorphous hydrocarbons are obtained will have viscosities of at least 125 SUS at 99° C. Most of these residual oils are commonly referred to as bright stocks.

MIDDLE DISTILLATE FUELS

The distillate fuel oils that can be improved by this invention include those having boiling ranges within the limits of about 120° to about 400° C. The distillate fuel oil can comprise straight run or virgin gas or cracked gas oil or a blend in any proportion of straight run and thermally and/or catalytically cracked distillates.

The most common petroleum middle distillate fuels are kerosene, diesel fuels, jet fuels and heating oils. Since jet fuels are normally refined to very low pour points there will be generally no need to apply the present invention to such fuels. The low temperature flow problem is most usually encountered with diesel fuels and with heating oils. A representative heating oil specification calls for a 10 percent distillation point no higher than about 226° C., a 50 percent point no higher than about 272° F., and a 90 percent point of at least 282° C. and no higher than about 338° C. to 343° C., although some specifications set the 90 percent point as high as 357° C. Heating oils are preferably made of a blend of virgin distillate, e.g., gas oil, naphtha, etc., and cracked distillates, e.g., catalytic cycle stock. A representative specification for a diesel fuel includes a minimum flash point of 38° C. and a 90 percent distillation point between 282° C. and 338° C. (See ASTM Designations D-396 and D-975).

The borated additive or additive combination of the invention may be used alone or in combination with still other fuel additives, e.g., corrosion inhibitors; antioxidants, sludge inhibitors, etc.

The invention will be further understood by reference to the following examples which include preferred embodiments of the invention.

EXAMPLES

The following materials were used:

Succinamide A

Succinamide A was the principal ingredient of a commercial product identified as Oronite 410 sold by Chevron Chemical Co. of San Francisco, CA which is believed to be at least 60 wt. % alkenyl succinamide and succinamic amine salt obtained by reaction of equimolar amounts of $C_{15}$–$C_{22}$ alkenyl succinic acid and di-tallow ($C_{16\ ave.}$) amine and the balance of said Oronite 410 appears to be 5–10 wt. % of a copolymer of ethylene and isobutyl acrylate containing about 40 wt. % acrylate and diluent materials.

The commercial product and its ingredients may be prepared according to U.S. Pat. Nos. 3,444,082 and 3,544,467.

Borated Succinamide A

The product was prepared by first dissolving 10 grams of said Oronite 410 in 160 ml. of toluene and thereafter adding 8 ml. of a 5 wt. % solution of boric acid in ethylene glycol. The mixture was refluxed while being stirred, for six hours, after which time the solvents were distilled off leaving 10 g. of a boron containing compound which analyzed about 0.5 wt. % boron.

AMORPHOUS HYDROCARBON

An amorphous hydrocarbon fraction (m.p. 43.9° C.) obtained by propane precipitation from the deasphalted residuum of a Texas coastal crude oil was found by mass spectrographic analysis, and by gas chromatography, to contain 5 wt. % of isoparaffins, 22 wt. % of aromatic hydrocarbons, 73% of cycloparaffins, and no more than a trace of normal paraffin hydrocarbons. The number average molecular weight of this material was about 775 as determined by osmometry.

The distillation characteristics of this solid hydrocarbon fraction were as follows:

Table I

| Distillation | | |
|---|---|---|
| (ASTM) D-1160) | Vapor Temp. at 5 mm Hg | Vapor Temp. Converted to Atmospheric Pressure |
| Initial BP | 228° C. | 401° C. |
| 5% | 310° C. | 497° C. |
| 10% | 336° C. | 526° C. |
| 20% | 364° C. | 557° C. |

Table I-continued

| Distillation | | |
|---|---|---|
| (ASTM) D-1160) | Vapor Temp. at 5 mm Hg | Vapor Temp. Converted to Atmospheric Pressure |
| 24% | 365° C. | 558° C. |

Only 24% would distill over
There were 75% bottoms and 1% loss

FUEL 1 AND 2

The properties of the middle distillate fuels 1 and 2 tested is summarized in Table II which follows:

Table II

| | Distillate Fuel 1 | Distillate Fuel 2 |
|---|---|---|
| Cloud Point, °C. | −3 | −16. |
| Gravity, API | 32.1 | 34.0 |
| Aniline Point | 71° C. | — |
| Distillation, °C. (per ASTM D-86) | | |
| Atmospheric | Distillate Fuel 1 | Distillate Fuel 2 |
| IBP | 158 | 184 |
| 5% | 189 | 208 |
| 50% | 265 | 273 |
| 95% | 342 | 324 |
| FBP | 350 | 340 |

Blending of the additives into the fuel was accomplished by their dissolution into the fuel oil. This was done while warming, e.g., heating the oil and additive to about 90° C. if the additive or additives per se were added, and stirring.

The blends were then tested for their cold flow properties in the tests described below.

THE COLD FILTER PLUGGING POINT TEST (CFPPT)

The cold flow properties of the blend were determined by the Cold Filter Plugging Point Test (CFPPT). This test is carried out by the procedure described in detail in "Journal of the Institute of Petroleum," Vol. 52, No. 510, June 1966 pp. 173–185. In brief, a 40 ml. sample of the oil to be tested is cooled by a bath maintained at about −34° C. Periodically (at each one degree Centigrade drop in temperature starting from 2° C. above the cloud point) the cooled oil is tested for its ability to flow through a fine screen in a time period. This cold property is tested with a device consisting of a pipette to whose lower end is attached an inverted funnel positioned below the surface of the oil to be tested. Stretched across the mouth of the funnel is a 350 mesh screen having an area of about 0.45 square inch. The periodic tests are each initiated by applying a vacuum to the upper end of the pipette whereby oil is drawn through the screen up into the pipette to a mark indicating 20 ml. of oil. The test is repeated with each one degree drop in temperature until the oil fails to fill the pipette within 60 seconds. The results of the test are reported as the temperature in °C. at which the oils fail to fill the pipette in the prescribed time.

The blends prepared and the test results are summarized in Table II which follows:

TABLE III

EFFECTIVENESS OF ADDITIVES IN THE FUEL

| Example | Wt. % a.i. | Additive | Fuel 1 CFPPT° C. | Fuel 2 CFPPT° C. |
|---|---|---|---|---|
| 1 | — | none | −4 | −17 |
| 2 | 0.16 | Succinamide A* | −9 | — |
| 3 | 0.05 | Succinamide A* | — | −23 |
| 4 | 0.05 | Borated Succinamide A | — | −27 |
| 4A | 0.08 | Borated Succinamide A | −12 | — |
| 5 | 0.15 | Borated Succinamide A | −13 | — |
| 6 | 0.06 | Succinamide A* | | |
| | 0.25 | Amorphous Hydrocarbon 1 | −11 | — |
| 7 | 0.04 | Borated Succinamide A | −17 | — |
| | 0.25 | Amorphous Hydrocarbon 1 | | |
| 8 | 0.25 | Amorphous Hydrocarbon | −5 | — |

*introduced as Oronite 410 containing about 60 wt. % Succinamide A.

The enhanced results obtained by the teachings of this invention are apparent from the foregoing Table III if a comparison is made between Example 2 and Example 5 where the CFPPT°C. is reduced. 4° C. through the practice of this invention and by a comparison of Example 3 with Example 4 where in the second fuel a decrease of 4° C. is realized. Further, a comparison of Example 6 with Example 7 shows that the prior teaching of U.S. Pat. No. 3,660,058 can be improved on by using the borated additive in combination with the amorphous hydrocarbon, i.e. a decrease of 6° C. is obtained.

These enhanced results are remarkable when compared with that obtained when borated derivatives of other oil-soluble nitrogen compounds are added to Fuel 1 as shown in Table IIIA (an extension of Table III)

TABLE IIIA

| Example | Wt. % a.i. | Additive Borated Derivative of | Fuel 1 CFPPT° C. |
|---|---|---|---|
| 10 | 0.12 | Armeen 2 HT[1] | −6 |
| 11 | 0.06 | Armeen HTA[2] | −5 |
| 12 | 0.08 | Armeen 2HT Diamide of Maleic Anhydride[3] | −1 |
| 13 | 0.08 | Amic acid salt of Maleic Acid and Armeen HTA[4] | −4 |

[1]A hydrogenated tallow amine sold by Armak Corp., Chicago, ILL wherein 4g is reacted 8 ml. of boric acid solution according to the procedure of Borated Succinamide A.

[2]$C_{18}$ secondary amine sold by Armak Corp., Chicago, ILL wherein 5g is reacted with 6 ml of boric acid soln. according to the procedure of Borated Succinamide A; said product analyzed out at 1.2 wt.% boron.

[3]10 gram of diamide reacted with 8 ml of boric acid soln. according to procedure of Borated Succinamide A.

[4]10 gram of salt reacted with 8 ml of boric acid soln. according to procedure of Borated Succinamide A.

It is seen that these borated additives of Table IIIA do not significantly lower the CFPPT.

The invention in its broader aspect is not limited to the specific details shown and described and departures may be made from such details without departing from the principles of the invention and without sacrificing its chief advantages.

What is claimed is:

1. A method of improving the cold flow properties of a middle distillate petroleum fuel oil boiling in the range of 120° to 400° C. and containing normal paraffin waxes which tend to precipitate in large crystals at low temperatures, which method comprises adding to said oil at least a cold flow improving amount of an oil-soluble cold flow improver which limits the size of precipitating wax crystals at low temperatures and which is a borated succinamic acid or its derivative having the following formula $$\begin{array}{l} R-CH-COX \\ \quad\;\; | \\ \quad\;\; CH_2-COX^1 \end{array}$$

wherein: R is a straight chain aliphatic hydrocarbon group having from 0 to 1 site of olefinic unsaturation (alkyl or alkenyl) attached at a secondary carbon atom to the succinyl group and is of about 15 carbon atoms to about 30 carbon atoms; one of X and $X^1$ is selected from the group consisting of OH and $OH(NHY^2Y^3)n$; and the other is $$-NYY^1$$

wherein N has its normal meaning of nitrogen and Y and $Y^1$ are aliphatic hydrocarbyl groups of from 14 to 30 carbon atoms and having a total of from about 30 to 52 carbon atoms; $Y^2$ and $Y^3$ are each selected from the group consisting of hydrogen, aliphatic hydrocarbon of 1 to 30 carbon atoms and oxyaliphatic hydrocarbon of 3 to 30 carbon atoms; and n is 0 to 1; said borated succinamic acid or its derivative containing from about 0.1 to about 2 percent by weight of boron.

2. A method of improving a middle distillate petroleum fuel oil according to claim 1, wherein one of X and $X^1$ is of said formula:

$$OH(NHY^2Y^3)_n$$

and said borated succinamic acid or its derivative contains from about 0.2 to 0.9 percent by weight boron.

3. A method of improving a middle distillate petroleum fuel oil according to claim 1, wherein said oil contains from about 0.001 to 1.0 wt. % of said oil-soluble borated succinamic acid or its derivative which is prepared by reacting a mixture of polyol and boric acid with the reaction product of about equi-molar amounts of $C_{15}$–$C_{22}$ alkenyl succinic acid or anhydride and a secondary amine having straight chain alkyl groups of 14 to 30 carbon atoms.

4. A method of improving a middle distillate petroleum fuel according to claim 1, wherein there is added to said oil about 0.01 to 1.0 wt. % of a flow and filterability improving combination comprising: (a) 1 to 5 parts by weight of said oil-soluble borated succinamic acid or its derivative; and (b) 1 to 100 parts by weight of an oil-soluble amorphous hydrocarbon having less than about 5 wt. % of normal paraffin hydrocarbons.

5. A method of improving a middle distillate petroleum fuel according to claim 4, wherein said borated succinamic acid or its derivative has about 0.1 to 2 wt. % boron, based on the weight of said borated succinic acid or derivative, and is prepared by reacting a mixture of polyol and boric acid with the reaction product of about equi-molar amounts of $C_{15}$–$C_{22}$ alkenyl succinic acid or anhydride and di-tallow amine.

6. A method of improving a fuel according to claim 5, wherein the weight ratio of said (a) to said (b) ranges from 4:1 to 1:25.

7. A method of improving the cold flow properties of a middle distillate petroleum fuel oil according to claim 1, wherein said oil-soluble borated succinamic acid or its derivative is obtained by reaction of about equi-molar amounts of $C_{15}$–$C_{22}$ alkenyl succinic acid or anhydride and ditallow amine, followed by reaction with a mixture of ethylene glycol and boric acid.

* * * * *